US005254450A

United States Patent [19]

Lacz et al.

[11] Patent Number: 5,254,450

[45] Date of Patent: Oct. 19, 1993

[54] HYDROPHOBICALLY SUBSTITUTED AMYLOSE STARCH-SIZED PHOTOGRAPHIC PAPER SUPPORT AND PHOTOGRAPHIC ELEMENT CONTAINING SAME

[75] Inventors: David J. Lacz, Honeoye Falls, N.Y.; Douglas L. Herrmann, Baltimore, Md.; Todd R. Skochdopole; Anita M. Fees, both of Rochester, N.Y.

[73] Assignee: Eastman Kodak Company, Rochester, N.Y.

[21] Appl. No.: 988,242

[22] Filed: Dec. 9, 1992

[51] Int. Cl.[5] ..... G03C 1/775

[52] U.S. Cl. ..... 430/538; 430/523; 430/537; 430/372

[58] Field of Search ..... 430/523, 538, 372, 537

[56] References Cited

U.S. PATENT DOCUMENTS 2,661,349 12/1953 Caldwell et al. .
3,368,891 2/1968 Laenen ..... 430/538
3,661,697 5/1972 Kimmel et al. .
4,283,486 8/1981 Aono et al. .
4,614,681 9/1986 Hayashi et al. .
4,665,014 5/1987 Katsura .
4,861,696 8/1989 Tamagawa et al. .
4,872,951 10/1989 Maliczyszyn et al. .

FOREIGN PATENT DOCUMENTS 391373 10/1990 European Pat. Off. .

*Primary Examiner*—Jack P. Brammer
*Attorney, Agent, or Firm*—Nixon, Hargrave, Devans & Doyle

[57] ABSTRACT

A photographic paper support is prepared formed by the following method: forming a paper sheet and drying it to about 10 percent water; applying an aqueous solution of hydrophobically substituted amylose starch to both sides of the sheet; drying this sheet to below 5 percent water; applying an aqueous solution of the hydrophobically substituted amylose starch to both sides of the sheet; drying this sheet to below about 10 percent water; and extruding a layer of polylefin on both sides of the paper sheet.

A silver halide color photographic reflection print element is formed by coating at least one color-forming silver halide emulsion layer on a photographic paper support prepared by the above described method.

13 Claims, No Drawings

HYDROPHOBICALLY SUBSTITUTED AMYLOSE STARCH-SIZED PHOTOGRAPHIC PAPER SUPPORT AND PHOTOGRAPHIC ELEMENT CONTAINING SAME

FIELD OF THE INVENTION

This invention relates to a method of forming a hydrophobically substituted amylose starch-sized photographic paper support and to a photographic element utilizing this support.

BACKGROUND OF THE INVENTION

Dyes used in color photographic materials are susceptible to degradation by a variety of environmental factors. For example, exposure to light of various wavelengths and intensities can cause fading of the dyes. In some instances, this fading is exacerbated by the presence of oxygen.

Various methods have been proposed to restrict the access of such agents as oxygen to photographic dye images. For example, U.S. Pat. No. 4,283,486 discloses an oxygen-impermeable or oxygen barrier layer comprising a vinyl alcohol polymer or copolymer positioned between a paper support and a color image-forming layer and reports improvement in the stability of dyes exposed to high intensity illumination.

U.S. Pat. No. 4,614,681 discloses a polyester film support in which an oxygen barrier layer comprising a copolymer of ethylene and vinyl alcohol is coated on the back side or on both sides of the support.

A paper support of low air permeability having a coating of a hydrophobic polymer on one or both sides of the paper is disclosed is U.S. Pat. No. 4,861,696, which further suggests that a waterproofing agent can be added to the hydrophobic polymer layer.

EP Application No. 391373 discloses a photographic paper support impregnated through the surface with a low level of a synthetic polymer such as a polyacrylamide or a polyvinyl alcohol as a paper strengthening agent.

A polyolefin resin-coated photographic paper support in which the anionic polyacrylamide and a cationic starch is included in the base paper for improved resistance to processing edge stain is disclosed in U.S. Pat. No. 4,665,014.

U.S. Pat. No. 3,661,697 discloses a water-resistant, grease-resistant, oxygen-resistant multi-ply packaging material, in which a paper base, a uniform continuous polyethylene layer, and a uniform continuous amylose layer are bonded together.

PROBLEM TO BE SOLVED BY THE INVENTION

It is highly desirable to stability of full color photographic prints containing yellow, magenta, and cyan dyes, which are frequently displayed. These prints are typically produced from elements comprising photosensitive dye-forming emulsion layers coated on a support that has been formed by coating a base paper with a polyolefin resin, usually polyethylene. A paper support that can be obtained without substantial interference with the current support preparation process and can be used to form a color photographic element having improved image stability is a challenging goal. The present invention achieves this goal.

SUMMARY OF THE INVENTION

In accordance with the present invention, a method of making a photographic paper support comprises (a) forming a paper sheet and drying it to about 10 percent water; (b) applying an aqueous solution of hydrophobically substituted amylose starch to both sides of the sheet; (c) drying this sheet to below about 5 percent water; (d) applying an aqueous solution of hydrophobically substituted amylose starch to both sides of the sheet; (e) drying this sheet to below about 10 percent water; and (f) extruding a layer of polyolefin on both sides of the paper sheet.

Also in accordance with the present invention, a silver halide color photographic reflection print element is formed by coating at least one color-forming silver halide emulsion layer on a photographic paper support prepared by the above described method.

ADVANTAGEOUS EFFECT OF THE INVENTION

The present invention provides an economical method for making a photographic paper support of low oxygen permeability and for obtaining color prints of increased stability. Furthermore, this improvement in dye stability is attained without a change in the image-forming materials in the photosensitive emulsion layers.

DETAILED DESCRIPTION OF THE INVENTION

In a full color photograph, the fading of the cyan image is caused primarily by the action of light. The degradation of the yellow and magenta images, on the other hand, is the result of the combined effects of exposure to light and oxygen. Impregnation of the paper support with hydrophobically substituted amylose starch in accordance with the method of the present invention greatly diminishes the oxygen permeability of the support, and a color photographic print element formed on such a support exhibits improved magenta and yellow image dye stability.

Impregnation of the paper sheet with sufficient hydrophobically substituted amylose starch to reduce oxygen permeability does not interfere with the subsequent extrusion coating of polyethylene layers on the paper sheet. Thus, the process of forming the photographic paper support is very similar to that in current use, with additional provision made for the application of hydrophobically substituted amylose starch to the paper sheet. Furthermore, the method of the invention allows formation of a color photographic element having improved image dye stability without a change in the image-forming materials.

Typically, the paper sheet is prepared from a mixture of wood pulp and water on a Fourdrinier paper-making machine, partially drying, preferably to below about 10% moisture content, the wet sheet and then applying the hydrophobically substituted amylose starch from an aqueous solution, preferably utilizing a size press. The sheet can be "nip-sized", whereby the solution of substituted amylose starch contained in a tank is applied to one side of the sheet by one of the press rollers immersed in the solution. Application of the solution to the other side of the sheet can be effected by spraying, using, for example, a perforated pipe located near the nip of the press rollers. Excess solution that accumulates on the surface of the sheet is removed as it enters the nip. Alternatively, the paper sheet can be "tub-sized" by immersing it in the sizing solution before contact with the press rollers. Additional sizing solution can be optionally applied to the sheet by a spray. The nip of the size press rollers aids the impregnation of the hydrophobically substituted amylose starch into the paper sheet.

The paper sheet so impregnated is dried typically by drum heaters and, in addition, may be optionally dried by radiant or hot air non-contact driers. The partially dried sheet, preferably at a moisture content below about 5%, is then further impregnated on both sides with hydrophobically substituted amylose starch at a second station, using apparatus and procedures such as those described above. After further drying, the paper sheet is calendered and extrusion coated on both sides with a polyethylene layer.

In accordance with the invention, the paper sheet can be of any desired basis weight. It is generally preferred that the sheet have a basis weight of between about 122 $g/m^2$ (25 lb/1000 $ft^2$) and about 244 $g/m^2$ (50 lb/1000 $ft^2$). A heavier weight paper of up to about 391 $g/m^2$ (80 lb/1000 $ft^2$) may be prepared for display purposes.

Amylose starch can be derived from any plant starch, for example, starch from corn, potato, wheat, rice, and the like. The base amylose starch, which preferably contains more than 50 weight percent amylose, can be substituted with hydrophobic groups by reaction with hydrophobic acylating agents. Suitable acylating agents include substituted succinic anhydrides, as disclosed in U.S. Pat. Nos. 2,661,349 and 4,872,951, incorporated herein by reference. The acylation products are starch monoesters of the substituted succinic acids. Thus, a hydrophobically substituted amylose starch prepared in this manner contains hydrophobic substituents such as octylsuccinoyl, decylsuccinoyl, dodecylsuccinoyl, 1-octenylsuccinoyl, 1-decenylsuccinoyl, 1-dodecenylsuccinoyl, and the like.

The water solubility and the tendency to retrograde of hydrophobically substituted amylose starch is affected by its degree of substitution, which is the number of ester substituents per anhydroglucose molecule of the starch molecule. Increased substitution tends to increase water solubility and diminish the tendency to retrograde. The hydrophobically substituted amylose starch of the present invention preferably has a degree of substitution of about 0.001 to about 0.10, more preferably about 0.01 to about 0.05.

The aqueous solution of hydrophobically substituted starch that is used to impregnate the paper sheet contains from about 8 to about 18 weight percent solids, preferably from about 9 to about 12 weight percent. The viscosity of the hydrophobically substituted starch solution that is applied to the sheet is from about 50 to about 400 centipoise, preferably about 200 to about 300 centipoise, at a temperature of about 60° C. (140° F.).

It has been found that, in the method of the invention, two applications of the aforementioned solution with drying after each application results in impregnation of both sides of the paper sheet with sufficient hydrophobically substituted amylose starch to provide the oxygen impermeability desired. The total amount of hydrophobically substituted amylose starch impregnated in the paper sheet is about 3 to about 10 weight percent, preferably about 5 to about 8 weight percent, based on the dry weight of the sheet.

The aqueous sizing solution also generally contains up to about 1 weight percent of sodium chloride to prevent the buildup of static electricity in the paper sheet. In either or both of the application steps, the solution of hydrophobically substituted amylose starch can also contain up to about 10 weight percent of polyvinyl alcohol to provide increased oxygen impermeability, as described in application Ser. No. 756,262 of Lacz et al., entitled "Photographic Paper with Low Oxygen Permeability", filed Aug. 19, 1991, which is incorporated herein by reference. In a preferred embodiment, the sizing solution contains up to about 3 weight percent of an aluminum salt, preferably aluminum chloride, which also reduces oxygen permeability of the paper support and improves image dye stability in a photographic print element of the invention.

The sizing operation may also apply to the paper sheet other addenda typically utilized in sizing solutions, for example, fillers, pigments, dyes, brighteners, hardeners, and strengtheners.

The polyolefin is applied to the hydrophobically substituted amylose starch-impregnated paper sheet by extrusion from a hot melt as is known from the art, for example, U.S. Pat. No. 3,411,908, incorporated herein by reference. In a preferred embodiment of the present invention, the polyolefin is polyethylene and is applied to both sides of the paper support. The total amount of coated polyethylene is from about 50 to about 200 $g/m^2$; in a preferred embodiment, both layers each contain at least about 70 $g/m^2$ of polyethylene.

The paper support of the present invention can be utilized in the formation of a photographic print element which, after exposing and processing, generates a dye image with improved stability to light. The yellow and magenta image dyes which benefit from the supports of the invention are formed by the reaction of oxidized color developing agents with 2- and 4-equivalent image couplers such as open-chain ketomethylene compounds, pyrazolones, pyrazolotriazoles, and pyrazolobenzimidazoles. Typically, such image couplers are ballasted for incorporation in high-boiling coupler solvents.

Couplers which form magenta dyes upon reaction with oxidized color developing agents are described in such representative patents and publications as: U.S. Pat. Nos. 2,600,788; 2,369,489; 2,343,703; 2,311,082; 2,908,573; 3,152,896; 3,519,429; 3,062,653; and T. H. James, editor, *The Theory of the Photographic Process*, 4th Edition, MacMillan, New York, 1977, pp 356–358, all incorporated herein by reference.

Couplers which form yellow dyes upon reaction with oxidized color developing agents are described in such representative patents and publications as: U.S. Pat. Nos. 2,298,443; 2,875,057; 2,407,210; 3,048,194; 3,265,506; 3,447,928; 5,021,333, and *The Theory of the Photographic Process*. pp. 354–356, all incorporated herein by reference.

In addition, other image couplers which can be used are described in the patents listed in *Research Disclosure*, December 1989, Item No. 308119, Section VIID, the disclosure of which is incorporated herein by reference.

Another key element to enhancing the useful lifetime of a color print is the reduction or elimination of the yellow stain which can form on prolonged exposure to light. This can be accomplished by coating an ultraviolet light (UV) absorber in the photographic element. Typically the UV absorbers are substituted phenylbenzotriazoles, which are described in such representative patents as U.S. Pat. Nos. 4,383,863; 4,447,511; 4,709,959; 4,752,298; 4,853,471; 4,973,701, which are incorporated herein by reference. Ultraviolet light absorbers which are liquids are preferred in order to minimize crystallization and surface blooming problems observed with solid absorbers.

Various layers to convert the paper support into a light reflecting print material, such as silver halide emulsion layers, subbing layers, interlayers, and overcoat layers are provided in the photographic element of the invention. The silver halide emulsion employed in the elements of this invention can be either negative-working or positive-working. Suitable emulsions and their preparation are described in sections I and II of *Research Disclosure*, December 1989, Item No. 308119, sections I and II, the disclosure of which is incorporated herein by reference. The silver halide emulsions employed in the present invention preferably comprise silver chloride grains which are at least 80 mole percent silver chloride and the remainder silver bromide.

The following examples further illustrate the invention.

EXAMPLE 1

Preparation of Photographic Paper Supports

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic corn starch, 0.5% polyamide-epichlorohydrin, 0.26% anionic polyacrylamide, and 5.0% $TiO_2$, all on a dry weight basis. A paper sheet with a basis weight of about 195 g/m$^2$ (40 lb/1000 ft$^2$) was made on a Fourdrinier paper machine, wet pressed to about 42% solids, and dried to a moisture of 10% using steam-heated dryers. The sheet was nip-sized with a solution containing 10 weight percent hydroxyethylated corn starch and 0.5 weight percent sodium chloride, using a vertical size press and a spray, to achieve a loading of 3.3 weight percent starch. The paper sheet was calendered to an apparent density of 1.04 g/cc, then extrusion coated on the front side with a layer approximately 25 μm (1 mil) thick of polyethylene containing 12.5 weight percent anatase $TiO_2$, 3.0 weight percent ZnO, 0.5 weight percent calcium stearate, and small amounts of antioxidant, colorants, and optical brightener. On the rear side it was extrusion coated with a layer of pure polyethylethylene of about 25 μm (1 mil) thickness. The control support so obtained was designated support (1).

Support (2) was prepared by a procedure similar to that used for support (1), but, instead of hydroxyethylated corn starch solution, a hydrophobically substituted amylose starch solution was used to size the paper sheet. The sizing solution was prepared by adding 17 weight percent of National® 78-0256 hydrophobic hybrid corn starch (from National Starch and Chemical Corporation) to water, cooking to a temperature of at least about 150° C. (300° F.) using a jet cooker, and diluting the resulting solution with water to 11.6 weight percent starch solids. To this solution was added 0.5 weight percent sodium chloride, and the pH was adjusted to 6.0 by the addition of sodium hydroxide; the viscosity of the resulting solution was determined to be 124 centipoise at 60° C. (140° F.), as measured by a Brookfield viscometer with a #2 spindle at 50 rpm.

The sizing solution was cooled to 60° C. (140° F.), and the sheet was tub-sized using a vertical size press with a spray. The excess solution that accumulated on the surface of the sheet at the nip was removed as it entered the nip. The sheet was then dried to a moisture content of about 3%. The sized sheet was passed through the tub-sizing apparatus a second time before drying and calendering to an apparent density of 1.04 g/cc. The content of hydrophobically substituted amylose starch in the sized paper sheet was gravimetrically determined to be 5 weight percent of the dried paper. This sheet was extrusion coated with polyethylene as described for support (1); the support so prepared was designated support (2).

The sizing procedure used to make support (2) was repeated for the preparation of support (3), except that the sizing solution additionally contained 0.5 weight percent aluminum chloride. The viscosity of this solution was determined to be 236 centipoise at 60° C. (140° F.), as measured by a Brookfield viscometer with a #2 spindle at 50 rpm. The sized paper sheet was gravimetrically determined to contain 5 weight percent of hydrophobically substituted amylose starch. Extrusion coating with polyethylene of the sized sheet was carried out as previously described; the support so obtained was designated support (3).

EXAMPLE 2

Measurement of Oxygen Permeability of Hydrophobically Substituted Amylose Starch-Impregnated Paper Supports The oxygen permeability properties of supports (1), (2), and (3) were determined by measurement of two values: oxygen leak rate and oxygen gas transmission rate. The oxygen gas transmission rate measurements were made according to ASTM D3985-81 on 50 cm$^2$ extrusion coated samples, with the side to be emulsion coated facing the chamber with the oxygen sensor, at 38° C. (100° F.) and approximately 65% RH, using pure oxygen. The oxygen leak rate was measured, using the same apparatus and test conditions, as follows: Nitrogen gas was introduced as the carrier gas in both the upper and lower chambers. After a suitable amount of time (30–180 minutes) the oxygen sensor was inserted into the lower chamber exhaust stream. Once equilibrium was established, the rate of oxygen reaching the sensor was recorded as the oxygen leak rate. The oxygen leak rate thus represents the rate that oxygen is reaching the sensor from (1) outgassing of the sample, (2) leaks in the system, and (3) leaks through the edge of the paper and diffusion through the polyethylene layer. Following the oxygen leak rate measurement, pure oxygen was introduced into the upper chamber (non-sensor side), and oxygen gas transmission rate measurements were carried out as described above.

The results of the oxygen permeability measurements for supports (1), (2), and (3) are given in Table 1 below:

TABLE 1

| Support | Oxygen Gas Transmission Rate cc/m$^2$/day | Oxygen Leak Rate cc/m$^2$/day |
|---|---|---|
| (1) (control) | 160 | 400 |
| (2) | 0.9 | 28 |
| (3) | 0.3 | 16 |

The oxygen gas transmission rate data for control support (1) and support (2) in Table 1 illustrate the very large reduction in oxygen permeability which resulted from impregnation of the paper sheet with hydrophobically substituted amylose starch in accordance with the present invention. As shown by the data for support (3), inclusion of aluminum chloride in the sizing solution resulted in a further significant lowering of both the oxygen gas transmission rate and the oxygen leak rate.

EXAMPLE 3

Preparation and Evaluation of Photographic Elements

On the front side of support (1), (2), and (3), prepared as described in Example 1, was coated a conventional color photographic material having the component layers shown in Table 2 below. The resulting color photographic print elements were designated Elements I, II, and III, respectively.

TABLE 2

| Layer No. | Layer | Material | Coverage ($mg/m^2$) |
|---|---|---|---|
| 7 | Protective | Gelatin | 1345 |
| 6 | UV absorber | Gelatin | 860 |
| | | UV Absorber W | 590 |
| 5 | Red-sensitive | Gelatin | 1076 |
| | | Red-sensitive silver halide* | 253 |
| | | Coupler C | 423 |
| | | Dibutyl phthalate | 212 |
| 4 | UV absorber | Gelatin | 860 |
| | | UV absorber W | 590 |
| 3 | Green-sensitive | Gelatin | 1237 |
| | | Green-sensitive silver halide* | 283 |
| | | Coupler M | 423 |
| | | Stabilizer S | 92 |
| | | Dibutyl phthalate | 211 |
| 2 | Interlayer | Gelatin | 753 |
| 1 | Blue-sensitive | Gelatin | 1506 |
| | | Blue-sensitive silver halide* | 292 |
| | | Coupler Y | 1076 |
| | | Dibutyl phthalate | 269 |

*Silver halide emulsions are $AgBr_1Cl_{99}$.

The structures of the cyan, magenta, and yellow couplers (couplers C, M, Y, respectively), ultraviolet light (UV) absorber W, and stabilizer S are given below:

Coupler C

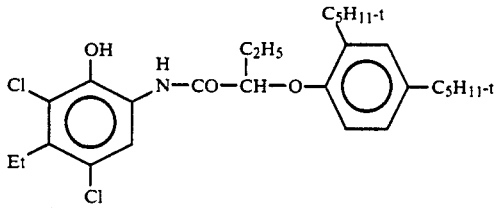

Coupler M

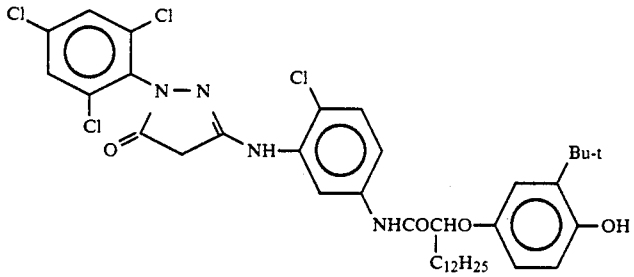

Coupler Y

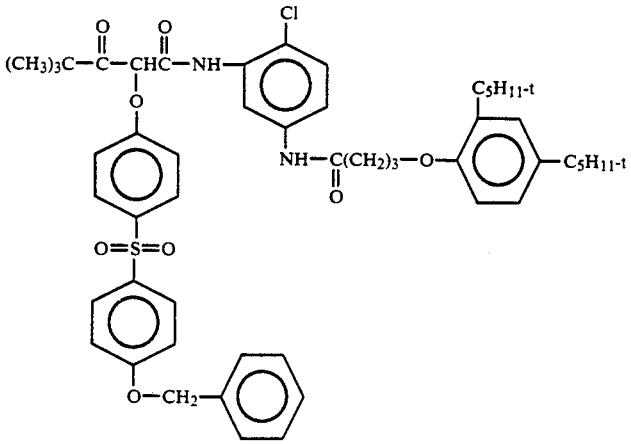

UV Absorber W

-continued

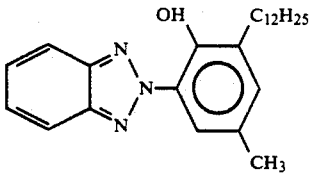

Stabilizer S

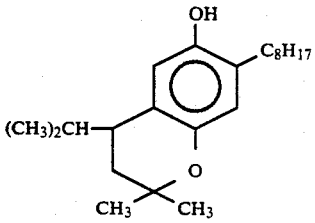

Elements I, II, and III were each exposed through an optical step wedge to red, green, and blue light to give separate cyan, magenta, and yellow dye records before standard Kodak Ektacolor RA-4 ® processing.

Dye stability of each of the separation dye records was determined by exposure for 28 days to a 50 Klux high intensity xenon light and measurement of the loss of density from an initial density of 1.0. The results are given in Table 3 below:

TABLE 3

| Element | Magenta Fade | Yellow Fade |
|---|---|---|
| I (control) | 0.73 | 0.55 |
| II | 0.66 | 0.48 |
| III | 0.59 | 0.41 |

The data in Table 3 illustrate the significant improvement in the stability to light of the magenta and yellow dye images from Element II, in which the paper sheet of the support had been impregnated with hydrophobically substituted amylose starch, over those from the control Element I, in which sheet had been sized with a solution of hydroxyethylated corn starch. A further appreciable improvement in dye stability was obtained from Element III, in which the substituted amylose starch sizing solution additionally contained aluminum chloride.

The invention has been described in detail with particular reference to preferred embodiments thereof, but it will be understood that variations and modifications can be effected within the spirit and scope of the invention.

What is claimed is:

1. A silver halide color photographic print element formed by coating at least one color-forming silver halide emulsion layer over a paper support prepared by (a) forming a paper sheet and drying said sheet to below about 10 percent water;

(b) applying an aqueous solution of hydrophobically substituted amylose starch to both sides of said sheet;

(c) drying said paper sheet to below about 5 percent water;

(d) applying an aqueous solution of said hydrophobically substituted amylose starch to both sides of said sheet;

(e) drying said paper sheet to below about 10 percent water; and (f) extruding a layer of polyolefin on both sides of said paper sheet.

2. The element of claim 1 wherein said hydrophobically substituted amylose starch contains octylsuccinoyl, decylsuccinoyl, or dodecylsuccinoyl substituents.

3. The element of claim 1 wherein said hydrophobically substituted amylose starch contains 1-octenylsuccinoyl, 1-decenylsuccinoyl, or 1-dodecenylsuccinoyl substituents.

4. The element of claim 1 wherein said hydrophobically substituted amylose starch contains at least about 50 weight percent amylose.

5. The element of claim 1 wherein said paper sheet contains from about 3 to about 10 weight percent of hydrophobically substituted amylose starch.

6. The element of claim 1 wherein said polyolefin is polyethylene.

7. The element of claim 6 wherein said paper support contains from about 50 to about 200 g/m$^2$ of polyethylene.

8. The element of claim 1 wherein said emulsion layer contains at least one yellow or magenta dye-forming coupler.

9. The element of claim 8 wherein said yellow dye-forming coupler is an open-chain ketomethylene compound.

10. The element of claim 8 wherein said magenta dye-forming coupler is a pyrazolone compound.

11. The element of claim 1 comprising an emulsion layer containing a yellow coupler, an emulsion layer containing a magenta coupler, and an emulsion layer containing a cyan coupler.

12. The element of claim 1 further comprising a layer that contains an ultraviolet absorber overlying said emulsion layer.

13. The element of claim 12 wherein said ultraviolet absorber is a substituted 2-phenylbenzotriazole compound.

* * * * *